United States Patent [19]

Van Duyn et al.

[11] Patent Number: 4,679,128

[45] Date of Patent: Jul. 7, 1987

[54] HEADLAMP BULB RETAINING ARRANGEMENT

[75] Inventors: Paul D. Van Duyn; John D. Geddie, both of Anderson, Ind.

[73] Assignee: General Motors Corporation, Detroit, Mich.

[21] Appl. No.: 888,990

[22] Filed: Jul. 24, 1986

[51] Int. Cl.[4] ..... F21V 7/00

[52] U.S. Cl. ..... 362/306; 362/61; 362/226

[58] Field of Search ..... 362/61, 226, 306, 443, 362/433, 434, 435, 436

[56] References Cited

U.S. PATENT DOCUMENTS

| | | | |
|---|---|---|---|
| 3,818,215 | 6/1974 | Schmidt et al. | 362/226 |
| 4,513,356 | 4/1985 | Mikola | 362/226 |
| 4,528,619 | 7/1985 | Dolan et al. | 362/226 X |
| 4,563,730 | 1/1986 | Saito | 362/264 |
| 4,590,542 | 5/1986 | Schauwecker et al. | 362/226 X |

*Primary Examiner*—Stephen Husar

*Attorney, Agent, or Firm*—Edward J. Biskup

[57] ABSTRACT

A retaining arrangement for a replaceable bulb mounted in a vehicle headlamp reflector that includes a grip member and a cooperating lock nut. The former of which is adapted to be press fitted onto and retained by spring fingers on a cylindrical boss surrounding the socket formed in the headlamp reflector.

3 Claims, 6 Drawing Figures

HEADLAMP BULB RETAINING ARRANGEMENT

This invention concerns vehicle headlamps and more particularly relates to a retaining arrangement for maintaining a replaceable bulb within a socket formed in the rear of a headlamp reflector.

More specifically the retaining arrangement according to the present invention is intended to be used with a bulb having an annular flange and a reflector having a socket defined by a cylindrical boss formed with an opening for receiving the bulb with the flange located in a predetermined angular position in engagement with the terminal end of the boss. In the preferred form the retaining arrangement includes a grip member in the form of a ring having a plurality of blades extending radially inwardly therefrom for permitting the grip member to be press fitted on the boss and maintained thereon. A plurality of circumferentially spaced lock tabs are formed on the peripheral surface of the grip member and the lock tabs cooperate with a plurality of cam slots formed in a lock nut so when the latter is mounted on the grip member the cam slots receive the lock tabs after which the lock nut is rotated causing the lock nut to move as a unit axially towards the grip member and be locked thereto. In addition, a plurality of radially inwardly extending spring fingers are provided on the lock nut and are adapted to engage the flange of the bulb and press the flange into firm engagement with the terminal end of the boss.

The objects of the present invention are to provide a new and improved retaining arrangement for a replaceable bulb mounted in a headlamp reflector and that includes a lock nut and a grip member the latter of which is adapted to be press fitted onto a cylindrical boss integrally formed on the rear of the headlamp reflector; to provide a new and improved retaining arrangement for a replaceable bulb that includes a grip member in the form of a ring having a plurality of radially inwardly extending blades which are adapted to cut into the cylindrical outer surface of a boss formed in the rear of a headlamp reflector so as to permit the grip member to be firmly secured to the boss and cooperate with a lock collar for retaining the bulb within a socket defined by the boss; and to provide a new and improved retaining arrangement for a replaceable bulb that includes a ring like grip member mountable on a cylindrical boss of a headlamp reflector and having radially inwardly extending blades the free ends of which lie on a circle having a diameter less than the outer diameter of the boss so when the grip member is fitted onto the boss the blades cut into the outer surface of the boss and prevent removal of the grip member.

Other objects and advantages of the present invention will be apparent from the following detailed description when taken with the drawings in which.

Figure 1:
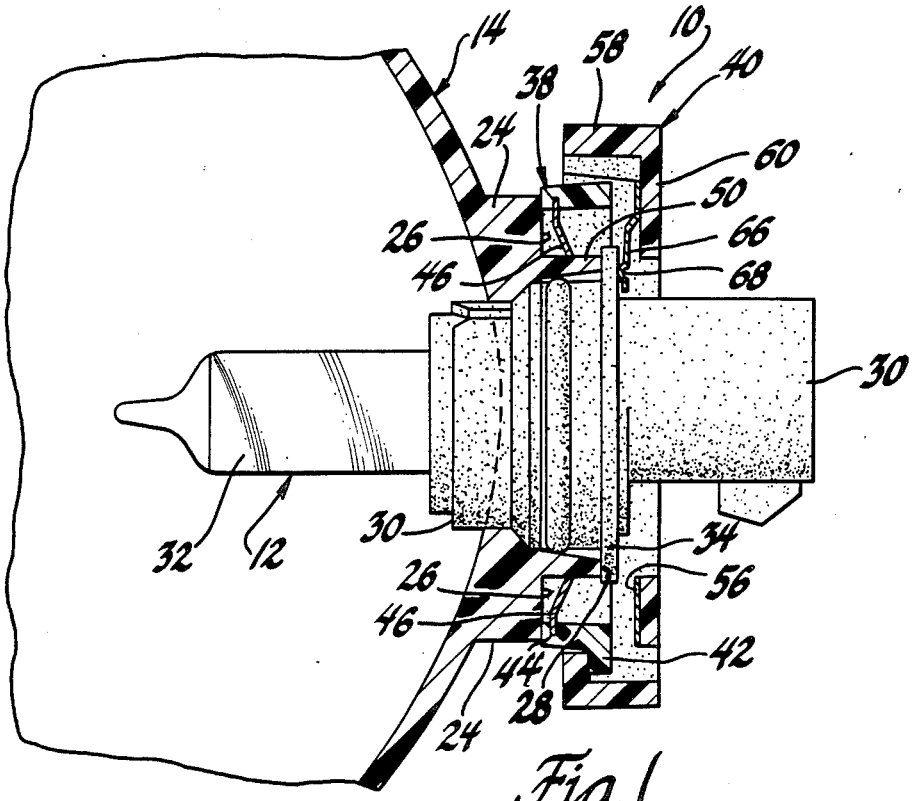
FIG. 1 is an elevational view partially in section showing a retaining arrangement according to the present invention maintaining a replaceable bulb in the socket of a headlamp reflector.
Figure 6:
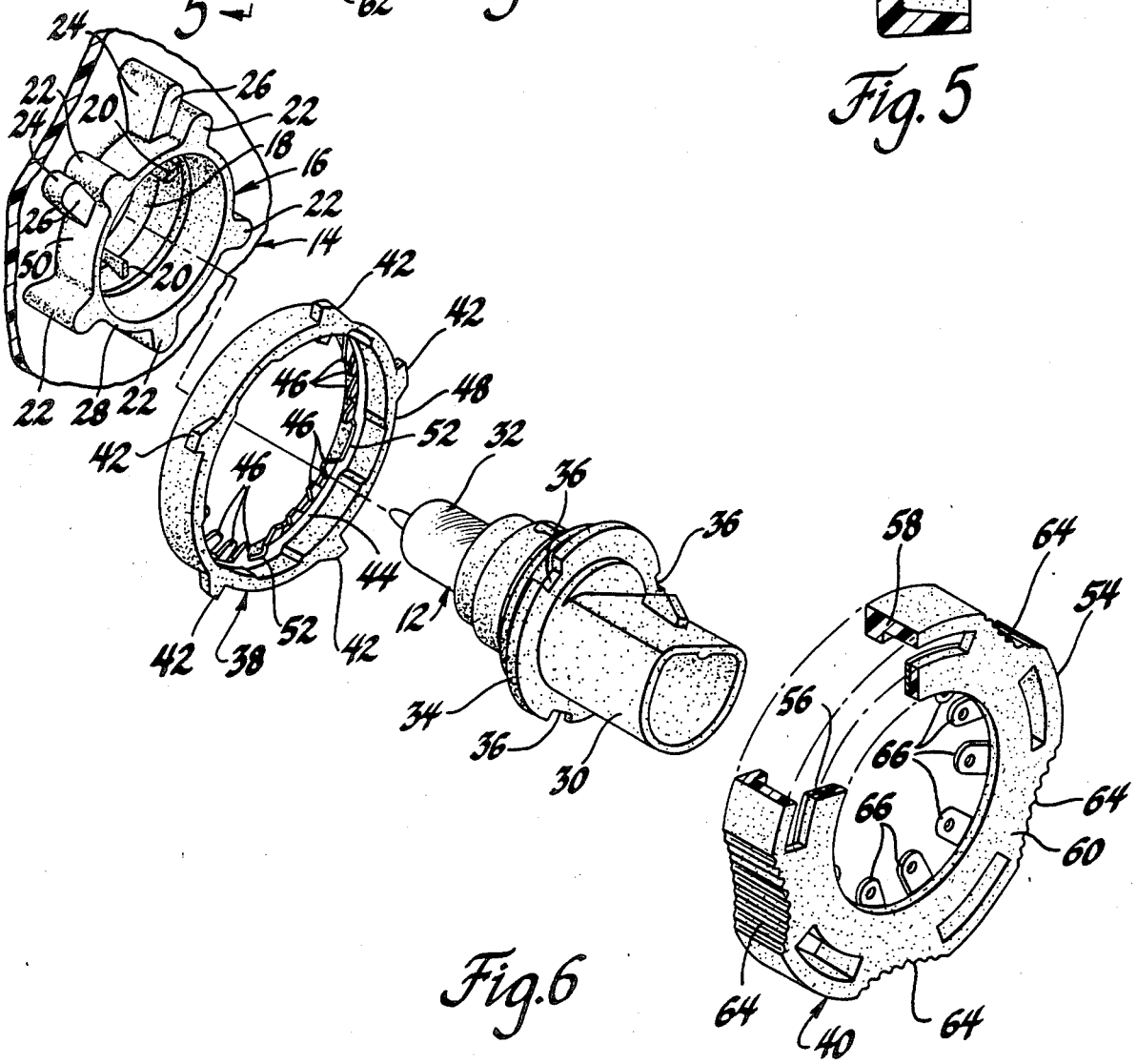
FIG. 6 is an exploded isometric view showing the bulb and the two parts of the retaining arrangement seen in FIGS. 1 through 5.

Referring now to the drawings and more particularly FIGS. 1 and 6 thereof, a retaining arrangement 10 is shown for maintaining a replaceable headlamp bulb assembly 12 within a socket formed in the rear of a headlamp reflector 14 which is made of a plastic material. The socket is defined by a cylindrical boss 16 which is integrally formed with the body of the reflector 14 and has a circular opening 18 provided with three circumferentially spaced and axially extending ribs (two of which are shown in FIG. 6). The outer peripheral surface of the boss 16 also has a plurality of circumferentially spaced ribs 22 integrally formed thereon adjacent each of which is a locator member 24 integral with the boss 16 and provided with a stop surface 26. The stop surfaces 26 are located in a predetermined plane which is substantially normal to the longitudinal center axis of the opening 18. The boss 16 terminates with an end surface 28 also located in a plane substantially normal to the aforesaid axis of the opening 18.

The bulb assembly 12 is of the conventional replaceable type having a molded plug body 30 which retains the base of a lamp 32. As seen in FIG. 6, the plug body 30 of bulb assembly 12 is formed with an annular flange 34 having three circumferentially spaced notches which are sized and angularly spaced so as to be complementary to the ribs 20 and thereby allow the plug body 30 to be located in the opening 18 of the boss 16 in the desired predetermined position relative to the boss. In this regard, it will be noted that when the bulb assembly 12 is located in the opening 18 of the boss 16, the flange 34 is in contact with the end surface 28 of the boss 16. Also, the bulb assembly 12 is retained in this position by the retaining arrangement 10 which includes a grip member 38 and a hand operated lock nut 40.

Figure 2:
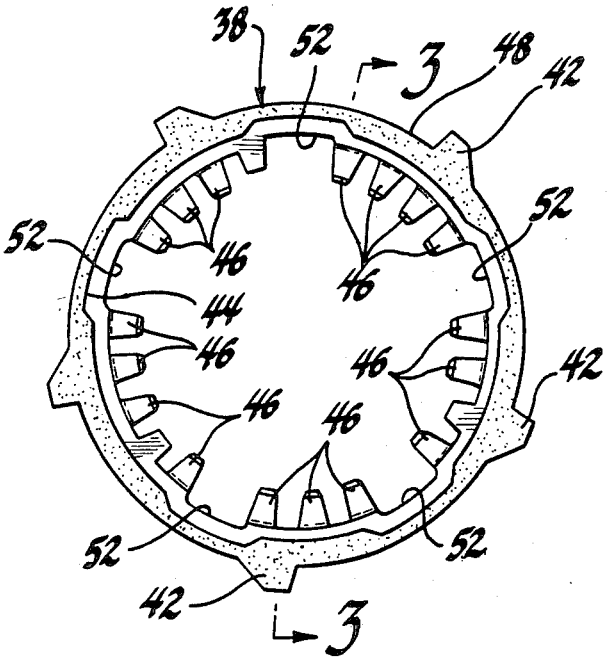
FIG. 2 is a front view of the grip member which forms a part of the retaining arrangement shown in FIG. 1.
Figure 3:
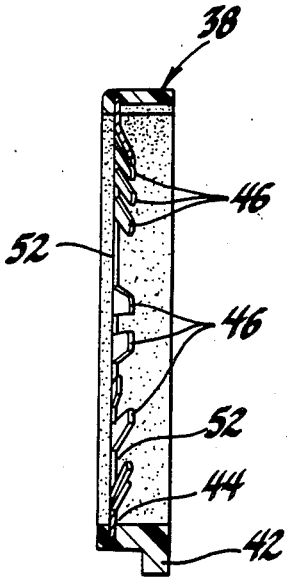
FIG. 3 is a sectional view of the grip member taken on line 3—3 of FIG. 2.

More specifically and as seen in FIGS. 2, 3, and 6, the grip member 38 takes the form of a ring made of a plastic material and has a plurality of identical circumferentially equally spaced lock tabs 42 integrally formed on the periphery thereof. As best seen in FIGS. 2 and 3, the inner opening of the grip member 38 has the peripheral edge of a metal ring member 44 firmly embedded therein. The ring member 44 is a rigid part of the grip member 38 and includes a plurality of radially inwardly extending blades 46 the free ends of which lie on a circle having a common center with the outer surface 48 of the grip member 38 and a diameter which measures less than the diameter of the outer surface 50 of the boss 16. As seen in FIG. 2, the blades 46 are located in sets of at least three blades 46 with each set being separated by a slot 52. It will also be noted that as seen in FIG. 3, the blades 46 are angled slightly towards the tabs 42. The slots 52 are angularly spaced from each other and located in the same relative positions as the ribs 22 formed on the boss 16. Thus as seen in FIG. 6, in mounting the grip member 38 onto the boss 16, the slots 52 are first aligned with the ribs 22, and the grip member is pressed onto the boss 16 until it is in contact with each of the end surfaces 26 of the locator members 24. As the grip member 38 is forced onto the boss 16, the free ends of the blades 46 cut into the outer cylindrical surface 50 of the boss 16 and lock onto the boss 16. Because the blades 46 are angled as seen in FIGS. 1 and 3, they prevent the grip member 38 from being removed and serve to securely fasten the grip member 38 to the boss 16.

Figure 4:
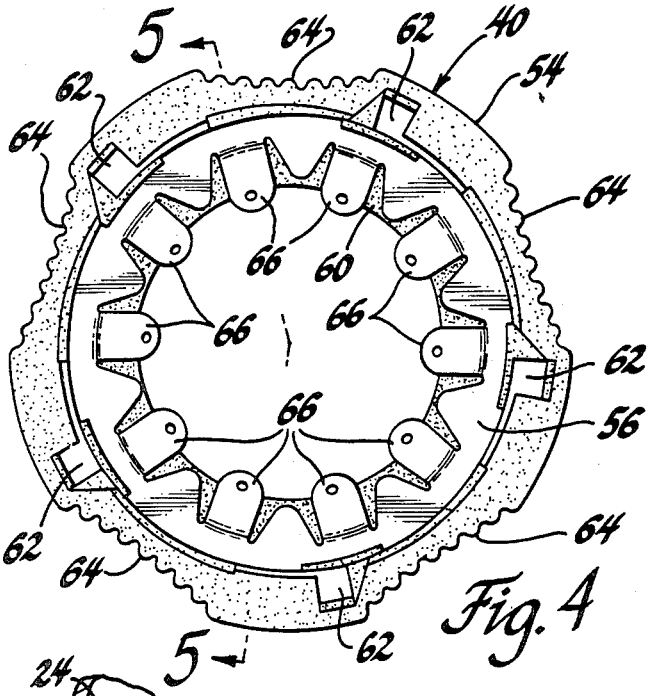
FIG. 4 is a rear view of the lock nut which forms a part of the retaining arrangement shown in FIG. 1.
Figure 5:
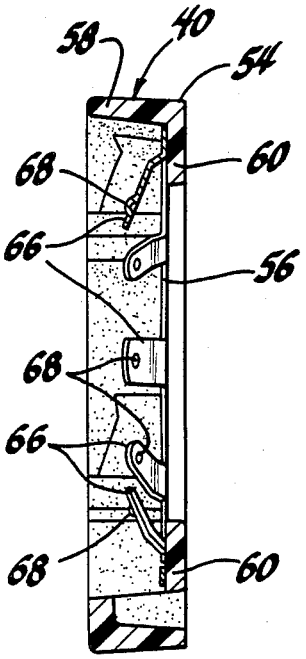
FIG. 5 is a view taken on line 5—5 of FIG. 4.

As alluded to hereinbefore, the lock member 40 is adapted to cooperate with the grip member 38 for maintaining the bulb 12 within the socket of the reflector 14. As seen in FIGS. 4 and 5, the lock nut 40 includes a molded plastic body portion 54 and a spring member 56. The body portion 54 is cup shaped as seen in cross section in FIG. 5, and has an axially extending rim 58 integral with a radially inwardly extending wall 60. The rim 58 is also formed with a plurality of circumferentially spaced cam slots 62 which cooperate with the lock tab 42 of the grip member 38 as will be explained hereinafter. In addition, the rim 58 is formed with a plurality of circumferentially spaced concave and ribbed sections 64 which facilitate finger operated rotation of the lock nut 40.

The spring member 56 is fixed to the wall 60 of the body portion 54 and is made of metal taking the form of a ring having a plurality of identical spring fingers 66 extending radially inwardly from the body of the spring member 56 in a cantilever fashion. The spring fingers 66 in the unflexed state are normally angled relative to the longitudinal center axis of the lock nut 40 and each spring finger 66 has a dimple 68 formed thereon as seen in FIG. 1.

From the above description and particularly as seen in FIG. 1, it should be apparent that after the bulb assembly 12 is inserted into the socket of the boss 16, the lock nut 40 is then manually located with its cam slots 62 axially aligned with the lock tabs 42 and then is bodily moved to cause the lock tabs 42 to be received by the cam slots 62. At the same time, the dimple 68 in each spring finger 66 will contact the flange 34 of the bulb assembly 12. Although not shown, each cam slot 62 has a ramp integrally formed on the inner surface of the rim 68. This ramp cooperates with the associated lock tab 42 so that once the lock tab 42 is in the cam slot and the lock nut is rotated, the lock nut will be drawn axially towards the grip member 38. This then causes the spring fingers 66 to apply a spring force onto the flange 34 forcing the same into firm contact with the end surface 28 of the boss 16. In this manner the lock nut is locked onto the grip member 38 and through the spring finger 66 serves to firmly maintain the bulb assembly within the socket of the reflector 14.

Various changes and modifications can be made in the above described invention without departing from the spirit of the invention. Accordingly the inventors do not wish to be limited except by the scope of the appended claims.

The embodiments of the invention in which an exclusive property or privilege is claimed are defined as follows:

1. A retaining arrangement for maintaining a bulb assembly within a socket located in the rear of a vehicle headlamp reflector, said bulb assembly having an annular flange, said socket being defined by a cylindrical boss having an opening for receiving said bulb assembly with said flange located in a predetermined angular position in engagement with the terminal end of said boss, said retaining arrangement including a grip member in the form of a ring having a plurality of blades extending radially inwardly from said grip member for permitting said grip member to be press fitted onto said cylindrical boss and maintained thereon, a plurality of circumferentially spaced lock tabs formed on the peripheral surface of said grip member, and an annular lock nut having a plurality of cam slots formed therein, a plurality of radially inwardly extending spring fingers formed with said lock nut, said lock nut adapted to be mounted on said grip member so that the cam slots receive the lock tabs after which the lock nut is rotated causing said lock nut to move axially towards said grip member and through said spring fingers press the flange of said bulb firmly into engagement with said terminal end of said boss.

2. A retaining arrangement for maintaining a bulb assembly within a socket located in the rear of a vehicle headlamp reflector, said bulb assembly having an annular flange, said socket being defined by a cylindrical boss having an opening for receiving said bulb assembly with said flange located in a predetermined angular position in engagement with the terminal end of said boss, said retaining arrangement including a grip member in the form of a ring having a plurality of blades extending radially inwardly from said grip member for permitting said grip member to be press fitted onto said cylindrical boss and maintained thereon, said boss having locator surfaces formed thereon and located in a plane substantially perpendicular to the longitudinal center axis of said opening so as to allow said grip member to be properly located on said boss, a plurality of circumferentially spaced lock tabs formed on the peripheral surface of said grip member, and an annular lock nut having a plurality of cam slots formed therein, a plurality of radially inwardly extending spring fingers formed with said lock nut, said lock nut adapted to be mounted on said grip member so that the cam slots receive the lock tabs after which the lock nut is rotated causing said lock nut to move axially towards said grip member and through said spring fingers press the flange of said bulb firmly into engagement with said terminal end of said boss.

3. A retaining arrangement for maintaining a bulb assembly within a socket located in the rear of a vehicle headlamp reflector, said bulb assembly having an annular flange, said socket being defined by a cylindrical boss having an opening for receiving said bulb assembly with said flange located in a predetermined angular position in engagement with the terminal end of said boss, said retaining arrangement including a grip member in the form of a ring having a plurality of blades extending radially inwardly from said grip member for permitting said grip member to be press fitted onto said cylindrical boss and maintained thereon, said blades being angled and the free ends of said blades being located on a circle having a diameter which is less than the outer diameter of said boss, a plurality of circumferentially spaced lock tabs formed on the peripheral surface of said grip member, and an annular lock nut having a plurality of cam slots formed therein, a plurality of radially inwardly extending spring fingers formed with said lock nut, said lock nut adapted to be mounted on said grip member so that the cam slots receive the lock tabs after which the lock nut is rotated causing said lock nut to move axially towards said grip member and through said spring fingers press the flange of said bulb firmly into engagement with said terminal end of said boss.

* * * * *